US008286686B2

(12) United States Patent
Cannaverde

(10) Patent No.: US 8,286,686 B2
(45) Date of Patent: Oct. 16, 2012

(54) WINDOW TREATMENT WITH CORD GUARD

(75) Inventor: Joseph Cannaverde, Stamford, CT (US)

(73) Assignee: Rollease, Inc., Stamford, CT (US)

( * ) Notice: Subject to any disclaimer, the term of this patent is extended or adjusted under 35 U.S.C. 154(b) by 0 days.

(21) Appl. No.: 13/331,264

(22) Filed: Dec. 20, 2011

(65) Prior Publication Data

US 2012/0160431 A1 Jun. 28, 2012

Related U.S. Application Data

(60) Provisional application No. 61/426,572, filed on Dec. 23, 2011.

(51) Int. Cl.
*E06B 9/38* (2006.01)

(52) U.S. Cl. ..... 160/320; 160/321; 160/178.1 R

(58) Field of Classification Search ..... 160/320, 160/321, 322, 344, 345, 178.1 R, 31, 172 R
See application file for complete search history.

(56) References Cited

U.S. PATENT DOCUMENTS

| | | | | |
|---|---|---|---|---|
| 19,226 | A | 1/1858 | Schleier | |
| 3,022,819 | A * | 2/1962 | Lampret | 160/345 |
| 3,050,803 | A * | 8/1962 | Hulterstrum | 24/129 R |
| 3,123,182 | A * | 3/1964 | Malone et al. | 188/65.1 |
| 3,123,351 | A | 3/1964 | Graber | |
| 3,633,646 | A * | 1/1972 | Zilver | 160/168.1 R |
| 4,813,469 | A * | 3/1989 | Scott | 160/178.2 |
| 4,846,766 | A | 7/1989 | Glatzel | |
| 5,125,447 | A * | 6/1992 | Suggs | 160/344 |
| 5,167,268 | A * | 12/1992 | Mao | 160/178.2 |
| 5,513,687 | A * | 5/1996 | Tuzmen et al. | 160/168.1 R |
| 5,553,653 | A * | 9/1996 | Rozon | 160/173 R |
| 5,577,543 | A | 11/1996 | Jelic | |
| 5,595,232 | A * | 1/1997 | Benthin | 160/178.1 R |
| 5,676,188 | A * | 10/1997 | Cadorette | 160/320 |
| 5,752,558 | A * | 5/1998 | Lin | 160/320 |
| 5,797,441 | A * | 8/1998 | Benthin | 160/173 V |
| 5,845,696 | A * | 12/1998 | Chou | 160/178.1 V |
| 6,085,824 | A | 7/2000 | Cadorette | |
| 6,463,987 | B1 * | 10/2002 | Nevins | 160/178.1 R |
| 6,792,999 | B2 * | 9/2004 | Cross et al. | 160/321 |
| 2003/0111188 | A1 | 6/2003 | Cross et al. | |
| 2005/0205219 | A1 | 9/2005 | Hsu | |

* cited by examiner

*Primary Examiner* — David Purol
(74) *Attorney, Agent, or Firm* — Gottlieb, Rackman & Reisman, P.C.

(57) ABSTRACT

In a window treatment with a cover for covering a window or other architectural opening, a cord assembly includes an elongated housing arranged to be installed next to the cover. The housing includes a channel around most of its periphery receiving the cord. Operating elements are provided on the housing to move the cord with respect to the housing to operate the window treatment and its cover.

15 Claims, 13 Drawing Sheets

WINDOW TREATMENT WITH CORD GUARD

RELATED APPLICATIONS

This application claims priority to U.S. Provisional application Ser. No. 61/426,572 filed Dec. 23, 2010 and incorporated herein by reference in its entirety.

BACKGROUND OF THE INVENTION a. Field of Invention

This application pertains to window shades and other window coverings, and more particularly to any cord-operated window or door covering systems, wherein a guard is provided for the cord (or chain) that makes the cord inaccessible.

b. Description of the Prior Art

Many different window and door covering systems and other treatment systems are presently available that can be used by residential, commercial and industrial consumers to cover a window or for other decorative purposes. Some of these systems may include window blinds, venetian blinds, roman shades, vertical blinds, and so on. A typical system of this kind includes a window covering element, a mechanism for raising, lowering, or otherwise opening or closing the window covering element and one or more cords used to control the mechanism. The cord may be a string, a rope, a continuous chain of plastic or metal beads, etc.

A problem associated with all such systems is that the cords may be openly accessible, for example, to children and may cause injuries if used incorrectly.

Some suggestions have been made in the past for solving these problems. For example, electronic systems have been designed that eliminate the need for a cord. However such electronic systems are too expensive and complicated for many situations. The present application provides a means of avoiding access to open window covering control cords.

SUMMARY OF THE INVENTION

A window treatment constructed in accordance with this invention includes a cover; header supporting the cover, the header including a mechanism for controlling an operation of the cover; and a cord system coupled to the mechanism for operating the cover. The cord system includes a cord engaging said mechanism, and an elongated housing arranged for mounting under said header, the housing having a peripheral channel accepting the cord, the cord and the housing cooperating to allow selective movement of the cord to operate said cover without exposing said cord.

In one embodiment, the housing is formed with a cutout sized and shaped to allow manually grasping said cord to move said cord vertically.

In another embodiment the system includes a manual slider slidably mounted on the housing and arranged to engage a portion of the cord to selectively move the cover up or down.

The housing includes two lateral portions extending along the length of the housing and having respective peripheral channels. A cord used to operate the window dressing includes a first portion passing along a first of said lateral portions and a second portion passing along a second of said lateral portions.

The cord can be selected from one of a bead, a strap, a chain, a string, and a rope.

The system optionally further includes a tensioning member for tensioning the cord.

In another aspect of the invention, a cord system for a window treatment for covering an architectural opening with a cover is presented. The cover is selectively operated by a mechanism controlled, all operated by a cord and a cord system. The cord system includes an elongated housing constructed for mounting adjacent to the cover. The housing includes a body with a peripheral channel accepting the cord. A cord activating element sized and shaped for manual grasping and movement of the cord with respect to the housing along the channel.

In one embodiment, the activating element includes a cutout in the housing and the channel, the cutout being large enough to allow a person to grasp the cord and move it longitudinally.

In another embodiment, the activating element includes a slider having a slider body formed with a vertical opening. The vertical opening is sized and shaped to receive the housing, the slider including a first cord engaging member extending into the channel to engage a portion of the cord, wherein moving the slider longitudinally along the housing causes the cord to move together with said slider.

In one embodiment, the slider includes a button disposed on said slider and extending into the channel to selectively engage the cord portion.

Preferably, the slider body has a first lateral side and a second lateral side, the button being accessible for manual manipulation from said first lateral side.

The cord system further includes a second button accessible from the second lateral side, wherein the first button engages a first portion of said cord and said second button engages a second cord portion, said first and second buttons being alternatively activated while said slider is moved in a pumping action to move said cord in a first direction. A bracket interconnects the first and second buttons.

BRIEF DESCRIPTION OF THE INVENTION

DETAILED DESCRIPTION OF THE INVENTION

Figure 1:
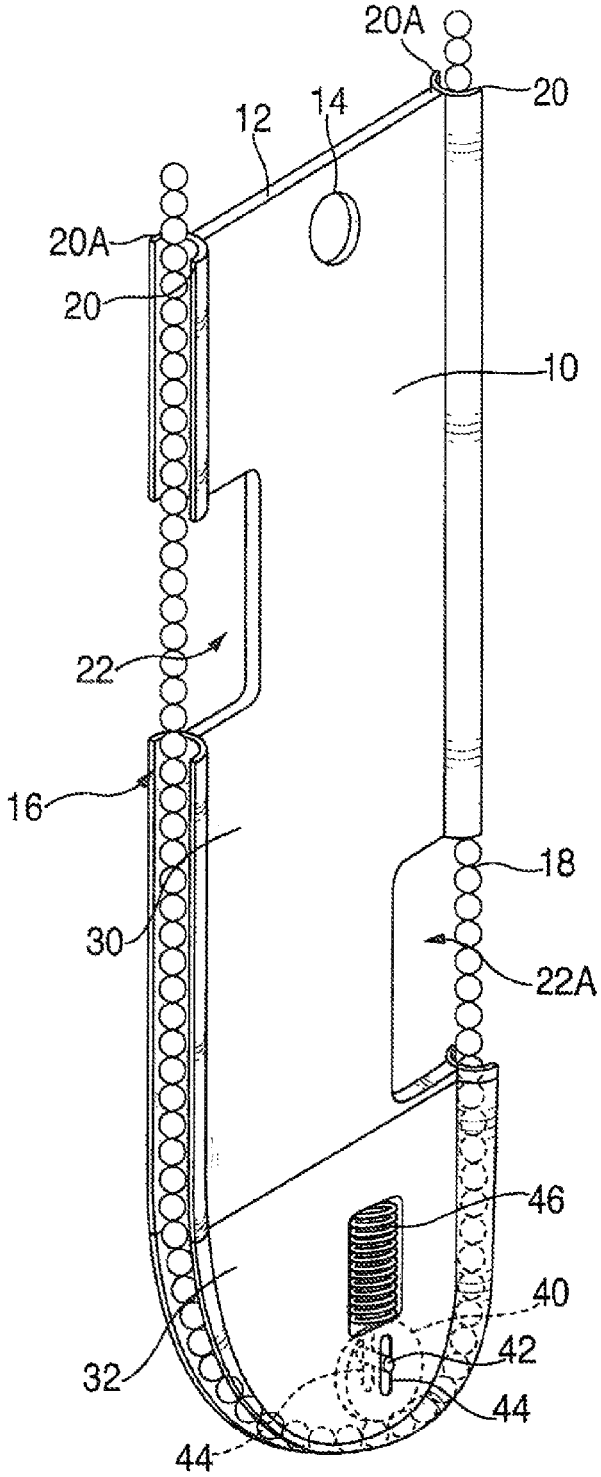
FIG. 1 is an orthogonal view of a cord system used in the window treatment of FIG. 1A.
Figure 1A:
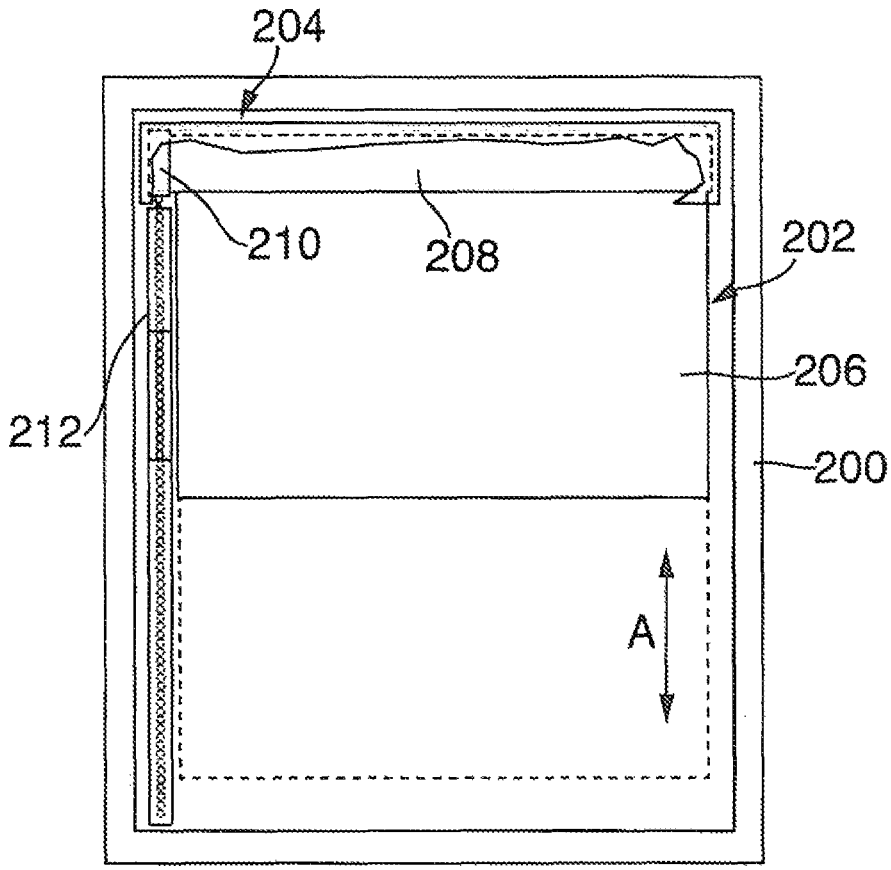
FIG. 1A shows a somewhat diagrammatic front view of a window treatment constructed in accordance with this invention.

Referring now to the drawings, and more particularly starting with FIG. 1A, a window, door or other architectural feature in a room includes an opening 200 provided with a covering system 202. The covering system 202 includes an upper portion, generally referred to as a header 204 and a cover 206. In many instances, the cover 206 is raised and lowered from a mandrel 208 disposed inside the header. A mechanism 210 (such as a clutch) disposed at one end (or in some cases, inside) the mandrel 208 and is used to selectively raise and lower the cover 206 as indicated by arrow A. In an alternate embodiment (such as a venetian blind, not shown), instead of, or in addition to raise or lowering the cover 206, the cover 206 stays in place and is manipulated to allow more or less light to enter through the opening 200 and/or for other purposes.

In any event, according to this invention, a cord assembly 212 is provided on one side of the opening 200. The assembly 212 is attached to, or at least positioned near the header 204 to allow contains a cord (described and discussed in more detail later) to pass into the header 204 and engage the mechanism 210 to control the operation of cover 206 as just described.

Cord assembly 212 is now described in conjunction with the remaining figures. Starting with FIG. 1, the cord assembly 212 includes a housing 10 having a generally elongated shape with a central portion or web 12 that is relatively thin, in the order of ⅛-¼". The web 12 may be provided at regular intervals with holes 14 or other means for mounting the cord assembly to the opening 200. The housing further includes a peripheral C-shaped channel 16 sized and shaped to receive cord 18. As seen in the figures, the channel 16 extends peripherally around the web 12, except along top edge 12A. The top edge 12A is straight so that it can abut a bottom surface of header 204.

Depending on the size, shape and weight of the cover 206, the cord 18 can be a string, a rope, a beaded chain, or other well-known long and thin member. The cord 18 can be made of a woven, knit, twisted, or braided material that can be natural or synthetic. However, for the following description, the cord 18 is descried as being made of a plurality of interconnected beads 18A forming a continuous chain. In this embodiment, the beads 18A are either molded from a plastic material, or are formed from a metallic allow.

As discussed above, central portion 12 is preferably thin to make the whole housing 10 light and inexpensive. The channel 16 is preferably formed by a curved wall 20 defining a passageway 20A for the cord 18. The passageway 20A has a partial circular cross section sized and shaped to match and receive the cord 18. Preferably the maximum cross-sectional dimension of the channel 16 is larger than the thickness of central section 12 as shown to allow cord 18 to move relatively freely through the channel without undue friction.

The passageway 20A holds, protects and guides cord 18 as it moves around the housing 10 and it preferably subtends an arc in the range of 90-180 degrees when viewed in cross-section.

Alternatively, if it is desired to protect the cord from the user or the user from the cord 18, the channel 16 can be shaped to surround cord either partially or completely. In the latter case, the passageway 20A is complete enclosed and is tubular. This latter configurations is more difficult to install since the cord must be threaded through the passageway 20A rather than training it around the housing 10.

At least on one side of the housing, a hand-sized cutout is formed in the channel 18, such as at 22 that may be typically 5-8" high. The cord 18 passes through this cutout and the cutout is sized and shaped to allow a user to grab the cord 18 and move it up or down. Preferably, the height or size of the cutout 22 is limited to insure that a free length of cord 18 visible through the cutout 22 cannot be pulled of the housing 10 easily and cause accidents. In an alternate embodiment, two cutouts 22, 22A are provided, one on each side of the housing 10. The cord in one cutout is then pulled downwardly to move the cover 206 in one direction while the cord 18 is pulled downwardly in the other cutout to move the cover 206 in the other direction. As described above, in some cases, the cord in one cutout or the other is moved to cause the cover to open or close without actually moving it.

Figure 2:
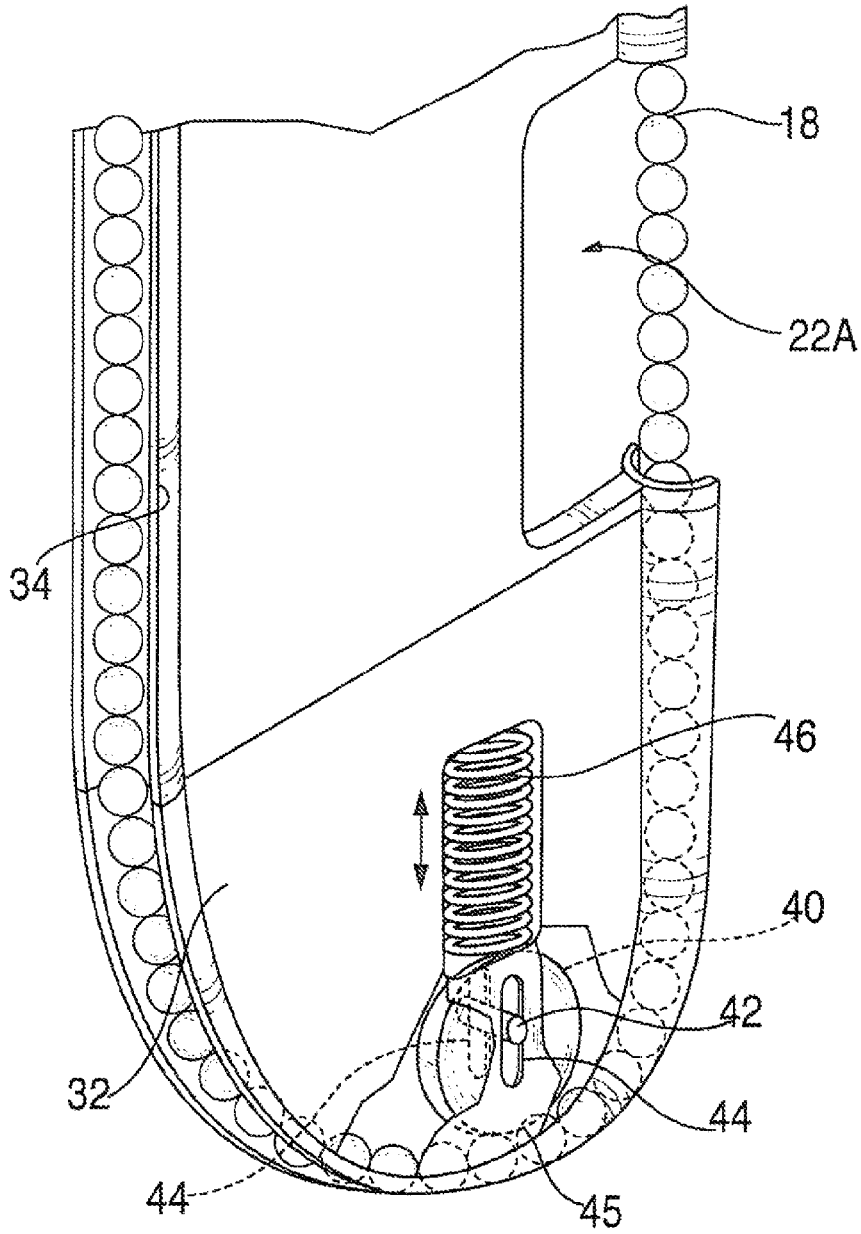
FIG. 2 shows an enlarged orthogonal view of a lower end of the cord system of FIG. 1.
Figure 3:
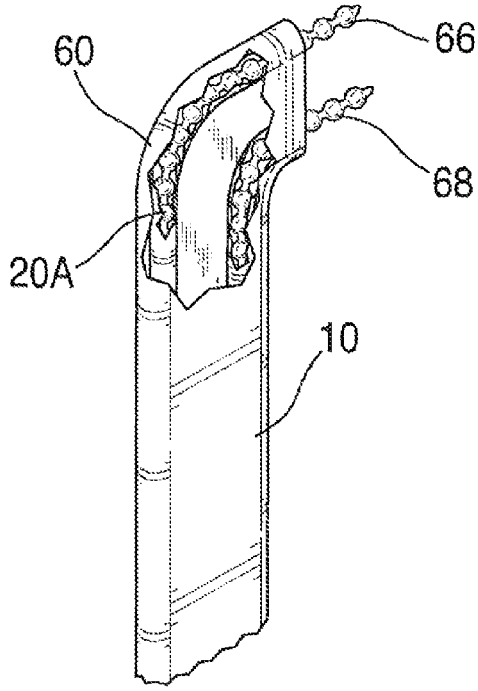
FIG. 3 is an enlarged view of a top portion of a first embodiment for the cord system of FIG. 2.

Depending on the size of the cord, the size of the window dressing, the height at which the window dressing is installed and other factors, the housing 10 can be made as a unitary element that is installed right below the mechanism 210, for example, by mounting it on a wall of the opening 200. Alternatively, (e.g., for taller openings 200), the housing 10 can be made of several modular pieces with a top piece 30 having a generally rectangular shape that extends downwardly from the header 204 and a bottom piece 32 that is formed with a semicircular portion 34 for turning the cord around, as can be seen in more detail in FIG. 2. Preferably, the two pieces 30, 32 are provided with tong-and-groove connectors (not shown) or other similar to interconnect the pieces to each other so that they are not easily separated.

In its simplest configuration, the housing and/or cord are sized and the housing is mounted in a way designed to insure that the cord is under tension. In this configuration, there will always be some rubbing between the cord and the housing. Therefore the housing should be made of a plastic material with a low coefficient of friction. This configuration may be difficult to implement in some configurations, especially for large and long housings. Therefore, it is advantageous to provide the housing with a means of tensioning the cord. One such tensioning means includes an idler roller 40 (see FIG. 2) rotating on a shaft 42. The shaft 42 is disposed in a cavity in housing 10, preferably in its bottom piece 32. The roller 40 has a circumferential outer surface having a groove having at least approximately the same size and shape as the passageway 20A. At the bottom of the housing 10, the roller 40 is aligned so that its groove replaces the bottom portion of channel 16 forming at least a portion of a rounded passageway 45 for the cord and being continuous with the passageway 20A in the channel 16.

The housing 10 is further formed with two vertical slots 44 with the shaft 42 being captured in the slots in a manner that allows it to move up and down. A compression spring 46 is arranged to apply a biasing force on the shaft 42 in the downward direction. The spring 46 applies a force on the idler roller 40 through shaft 42 thereby tensioning the cord 18. The spring 46 and wheel 40 are sized and arranged to insure that at its lowest position, the wheel 40 does not protrude from the housing 10. As a result of the tension applied by the wheel 40 on cord 18, the cord 18 has very little play in it even in the cutouts 22, 22A.

As discussed above, in one embodiment of the invention, the housing 10 is mounted below but separate from the header 204 so that the cord 18 comes out of the header 204 passes through the passageway formed around the housing 10 and then back into the header 204.

Figure 4:
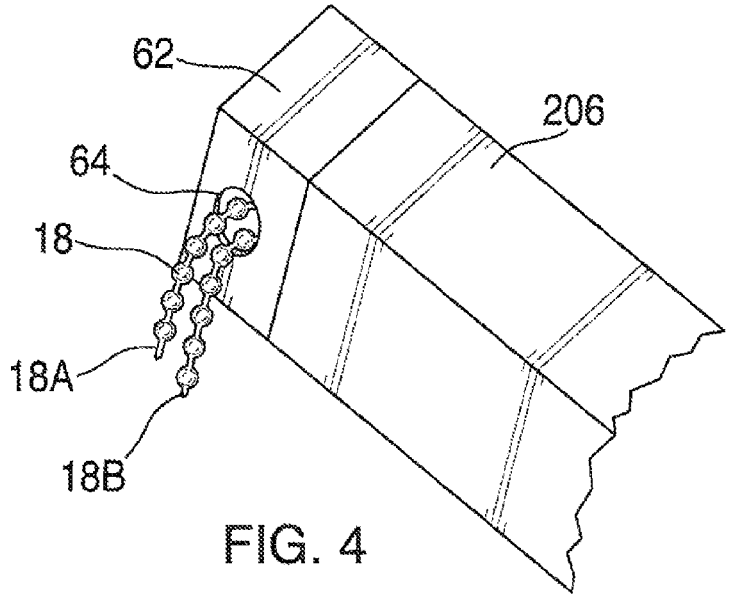
FIG. 4 shows an orthogonal view of a header modified to receive the end of the cord system of FIG. 3.

In another embodiment, the housing 10 is attached to the header 204. For example, as shown in FIG. 4, header 204 includes an end 62 with a feedhole 64. The cord 18 exits through this feed hole. An adapter 60 is attached to housing 10. The adapter has the shape of a 90° elbow with two flanges 66, 68 adapted for attachment to the top and bottom of end 62. Inside the elbow a cavity (not shown) is formed that is arranged to guide the cord ends 18A, 18B as they exit 64 to the peripheral passageway 20A described above.

Figure 5:
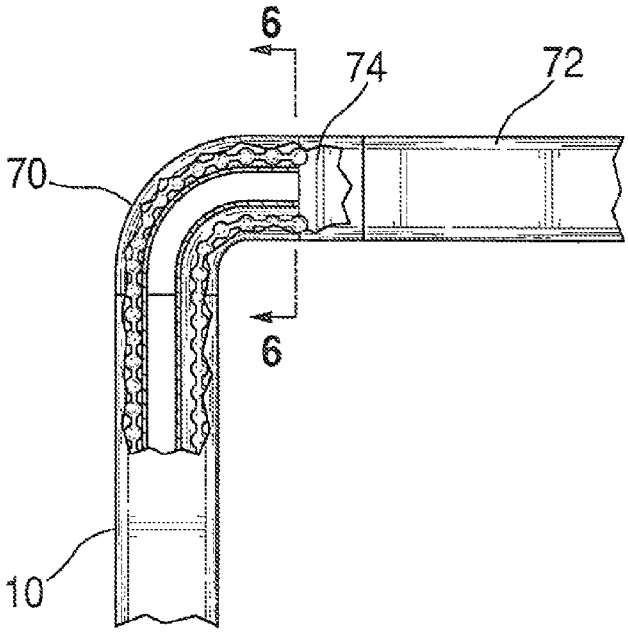
FIG. 5 shows a side view of an upper portion of the cord system of FIG. 3 inserted into the header of FIG. 4.
Figure 6:
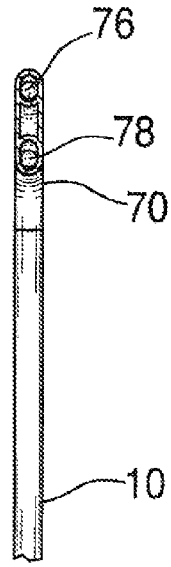
FIG. 6 shows an end view of the upper portion of the cord system of FIG. 3.

In another embodiment (FIGS. 5 and 6) more suitable for surface mounted window coverings, a header 72 is provided with a lateral hole 74. An elbow 70 is attached to the end surface of header 72 and is formed with two holes 76, 78 to accept and guide the ends of the cords to the cord guide 10 as shown.

Figure 7:
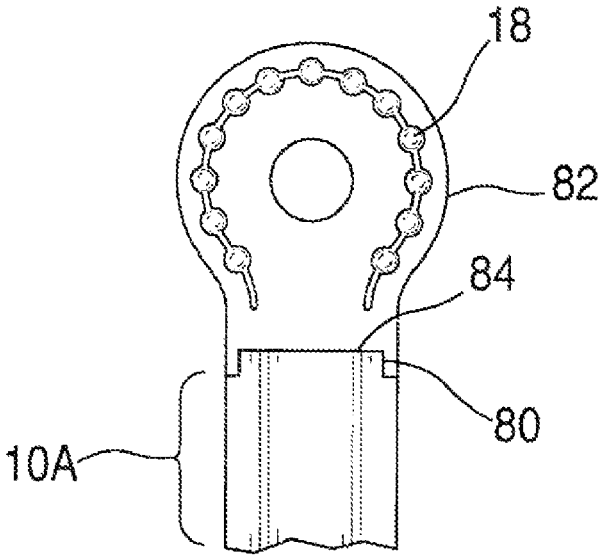
FIG. 7 shows a side view a top portion of another embodiment of a cord system in which the housing is attached to a clutch guard.
Figure 7A:
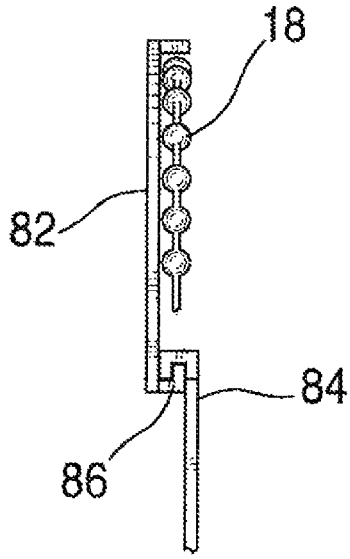
FIG. 7A shows a cross-sectional the embodiment of FIG. 7.

In another embodiment shown in FIGS. 7 and 7A, a housing 10A has an end 80 designed to be attached to the clutch guard 82 of a header (not shown). The end 80 is formed with a hook 84 that pass over a lip 86 formed on the clutch guard 82. In this manner the housing 10A is attached or mounted on the clutch guard 82 and accepts cord 18 as described.

Figure 7B:
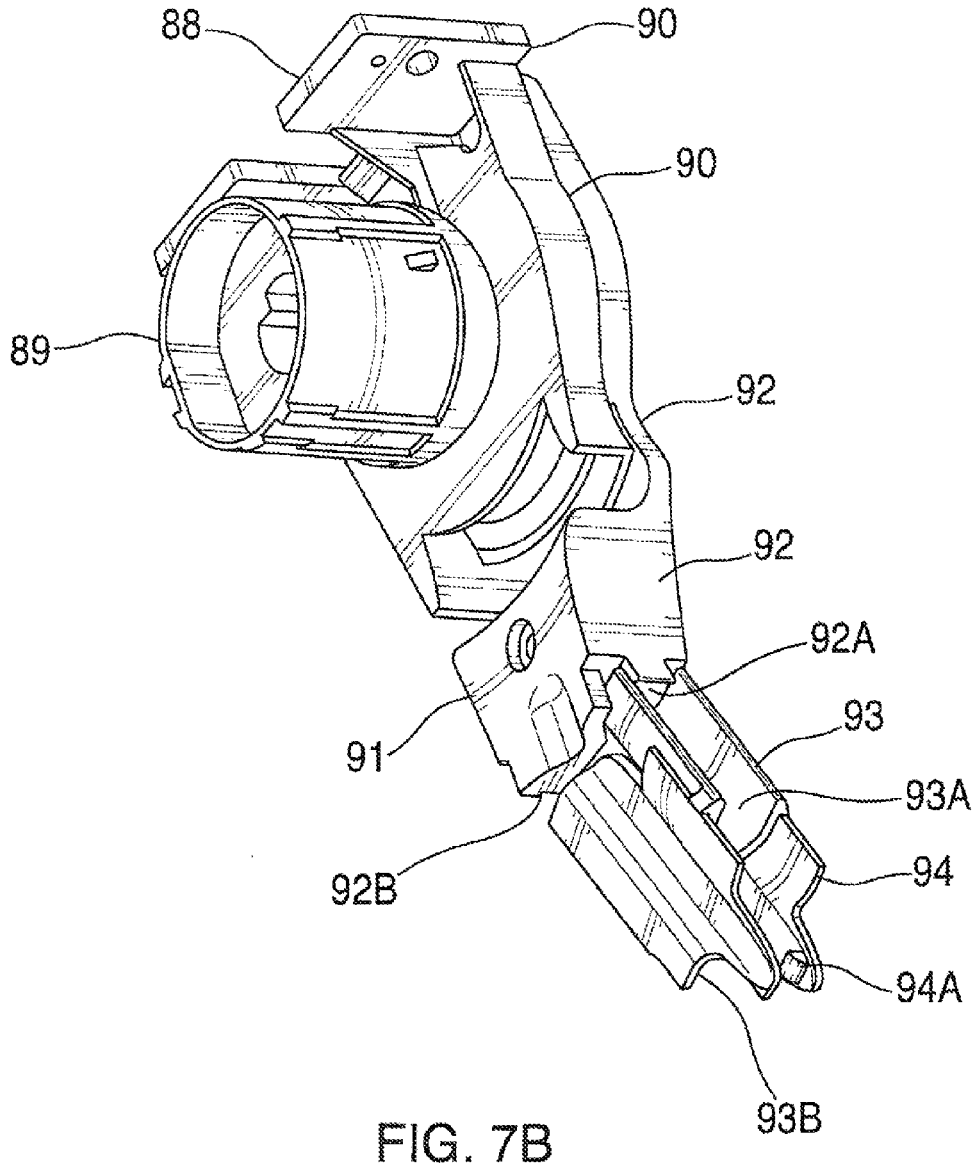
FIG. 7B shows an orthogonal view of an arrangement for attaching a cord guide to a roman shade support.

FIG. 7B shows an arrangement for attaching a cord guide to a roman shade. The roman shade includes an end 88 with a mandrel 89 on a guard 90. Guard 90 is attached to the wall or ceiling of a window. (not shown). A cord (not shown) is disposed inside the guard 90 so that pulling one or the other end thereof causes the mandrel to rotate about its horizontal axis. According to this invention, a back wall 92 is attached to the guard 90 and has a downward extension 91 attached to a bottom piece 92 to form to passages 92A, 92B. An adapter 93 is attached to the bottom of the extension 91 and includes passages 93A, 93B to guide the cord from the guard 90 to a cord guard, such as the one in FIG. 1.10. The adapter 93 includes a lower extension 94 with a pin 94A engaging a hole in housing of the guard.

Figure 7C:
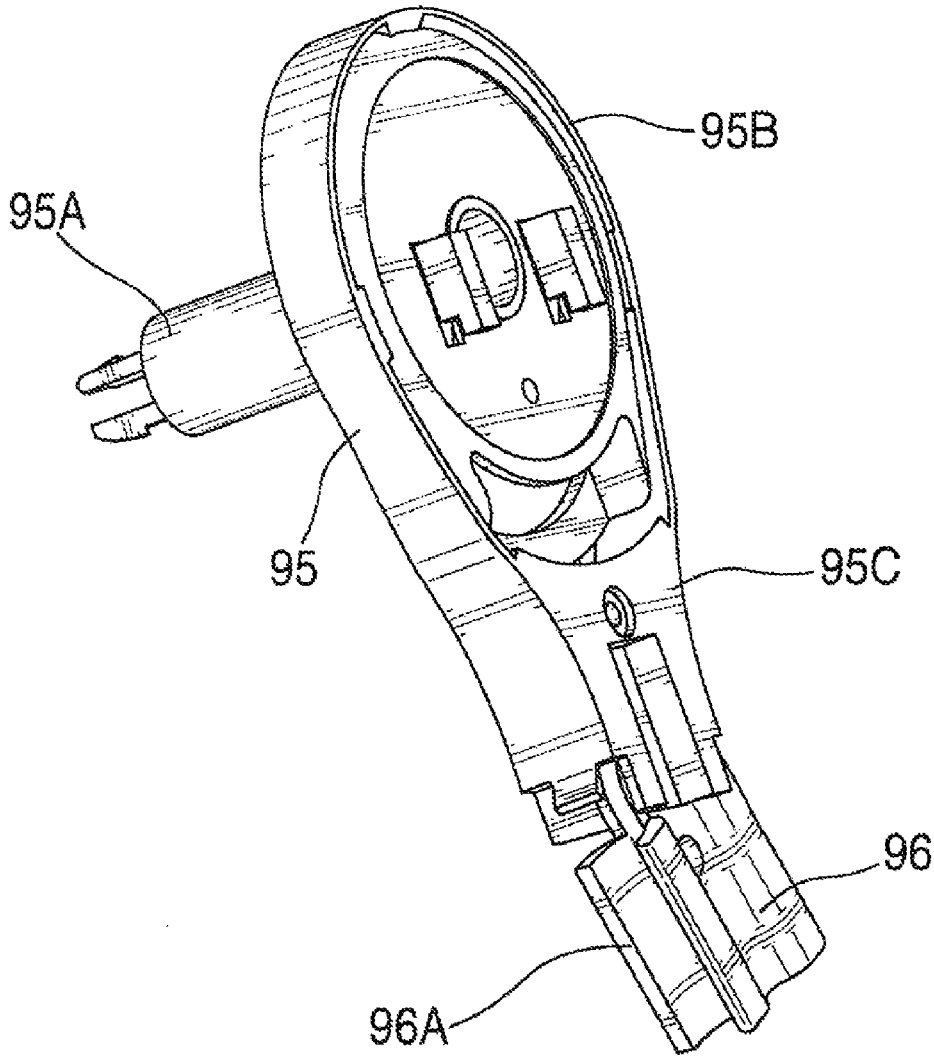
FIG. 7C shows an orthogonal view of an arrangement for attaching a cord guide to a standard window shade.

FIG. 7C shows an arrangement for attaching a cord guide to a standard window shade. In this embodiment, shaft 95A engages a standard window shade and is selectively rotated by a cord in guard formed by disc 95B and a member 95. Member 95 has a downwardly extending portion 95C. An adapter 96 is used to guide the cord to the housing 10. The adapter includes lateral channels, as at 96A for the cord.

Figure 8:
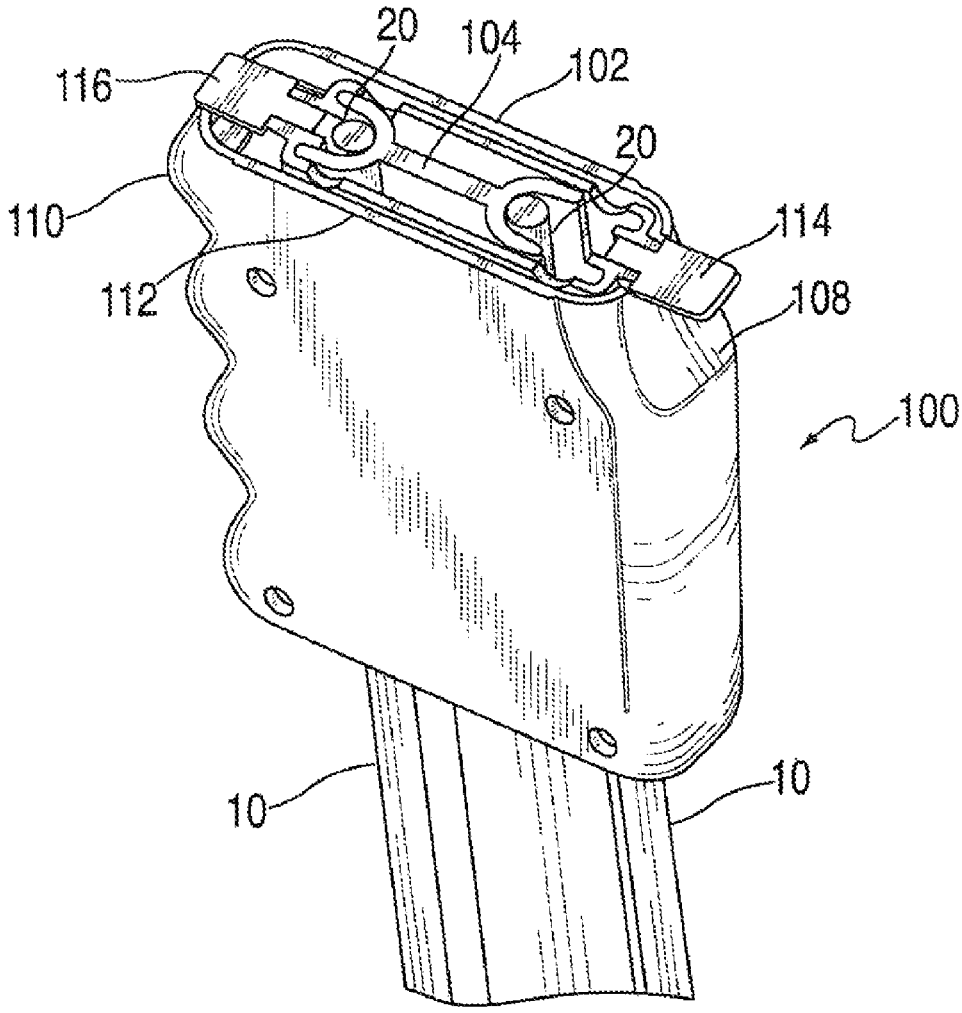
FIG. 8 shows an orthogonal view of a slide switch used with the embodiment of FIGS. 4-6.

In another embodiment, instead of, or in addition to the cutouts 22, 22A, a slider 100 (shown in FIGS. 8-10), is provided to operate the cord 18. The slider 100 includes a shell 102 with an oval opening 104 shaped to receive the housing 10 and allow the shell 102 to move longitudinally along the housing 10 and the cord 18. The housing 10 may be provided at the top and the bottom with stops (not shown) to limit the movement of the slider switch.

The shell 102 has two sidewalls 108, 110. At least one of the sidewalls, such as 110 is fluted as at 106 to allow a person to grip the slider switch 100 comfortably. The other sidewall 108 includes at least one indentation 109 for the thumb of a person.

A bracket 112 extends transversally within the shell and is connected to two buttons 114, 116. The bracket 112 is sized and shaped to allow sufficient room within the opening 104 for the housing 10 to move with respect to the slide switch 100 without any interference. In order to insure that the bracket is strong enough, it may be shaped with two sections, one on each side of the flat housing 10. Buttons 114, 116 are sized and shaped to extend inwardly between the portions of the wall 20 defining 16 without any interference therewith.

Each button 114, 116 is attached to a shoe 118, 120 that has a respective surface 115, 117 shaped and sized to fit over and create an interference fit with a portion 19 of the cord 18 within the opening 104. For example, if the cord 18 is made of a spherical beads 18A, then the shoes 118, 120 have partial spherical indentations on one side that match the size and spacing of the beads In one embodiment, the slider switch 100 is made with detents (not shown) or other similar well known means which maintain the bracket 112 in either of two positions. In one position shown in FIG. 9, the button 116 is pushed in causing the shoe 118 to engage the corresponding segment 19 of the cord 18 and push it against the inside wall 21 of the channel 20. In this manner, an interference fit is created between the shoe 118 and the inside wall 21 allowing the slider switch 100 to grab the portion 19 of the cord 18. In this position of bracket 112, button 114 is in an extended position above the outer surface of sidewall 108 and its shoe 120 is remote from, and is not in contact with another cord portion 21.

Pushing button 114 inward shifts the bracket 112 to its second position. In this position, the show is disengaged from cord portion 19. On the other hand, shoe 120 now engages the portion 21 of cord 18.

This arrangement allows the user to grasp the slider 100 and pimp it up and down very quickly to raise or lower the cover 206 rapidly. For example, if the slider is initially in position shown in FIG. 9 and the right side of the slider is the top, then pushing down on the slider 100 causes the portion of cord 18 with section 19 to move down. At the bottom of the stroke, the user flips the bracket 112 by pushing the button 114 in. This causes the shoe 118 to disengage from portion 19 and show 120 to engage portion 19. Then, the user lifts the slider causing the portion 19 to go up. At the top of the stroke, the user pushes the button 116 thereby engaging portion 19 again.

The cord 18 can be moved rapidly in the other direction as well by reversing the above sequence. This operation is a quick, easy and safe way to operate the cord.

In another embodiment, detents are provided to set the bracket 112 in a third position in which both shoes engage the cord (thereby blocking it from moving). In another embodiment, the slider switch is provided with detent that hold the bracket in a neutral position in which neither shoe engages the cord thereby allowing the slider to be moved up and down freely without moving chord 18.

Figure 9:
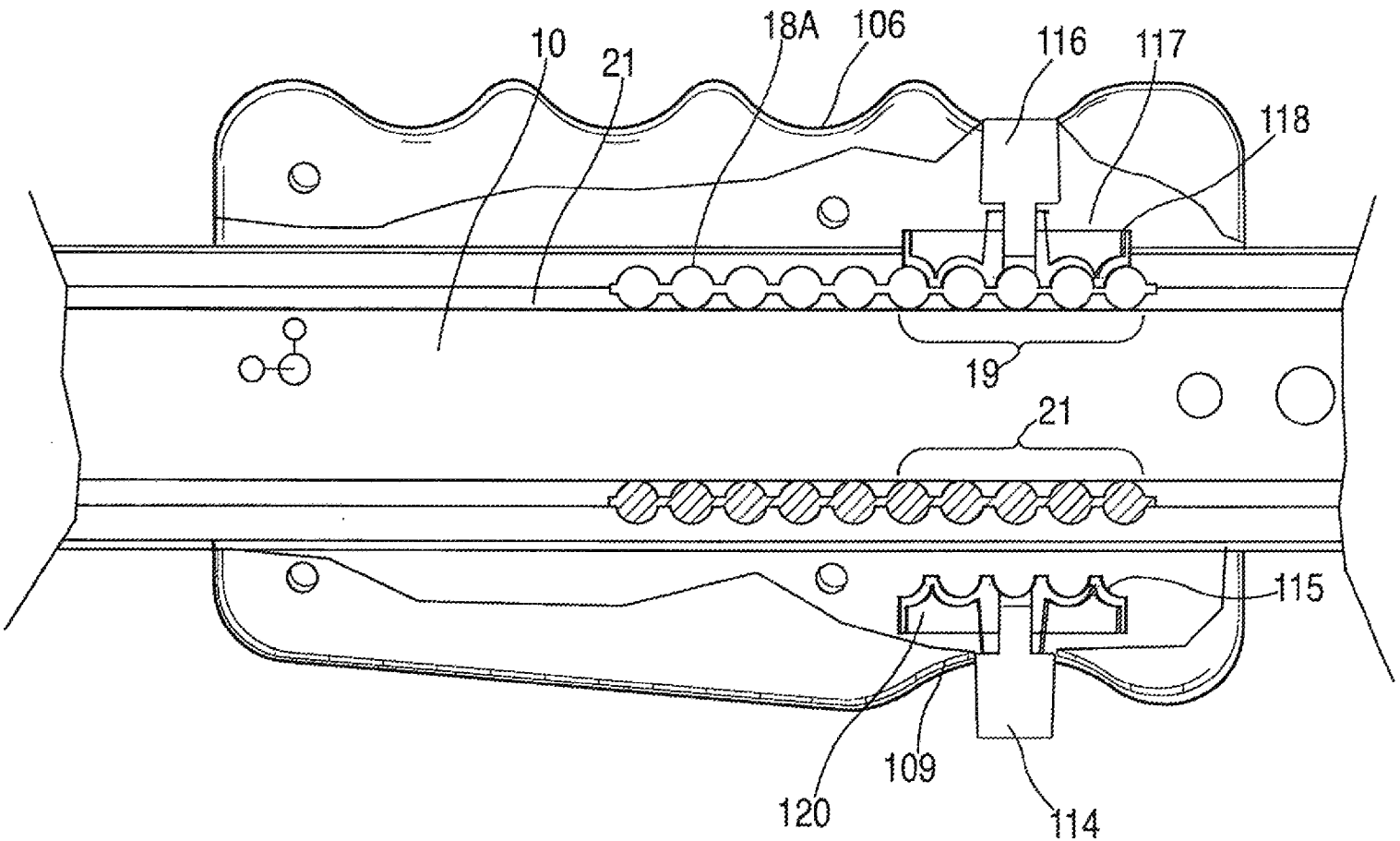
FIG. 9 shows a cross-sectional view of the slide switch of FIG. 8.
Figure 9A:
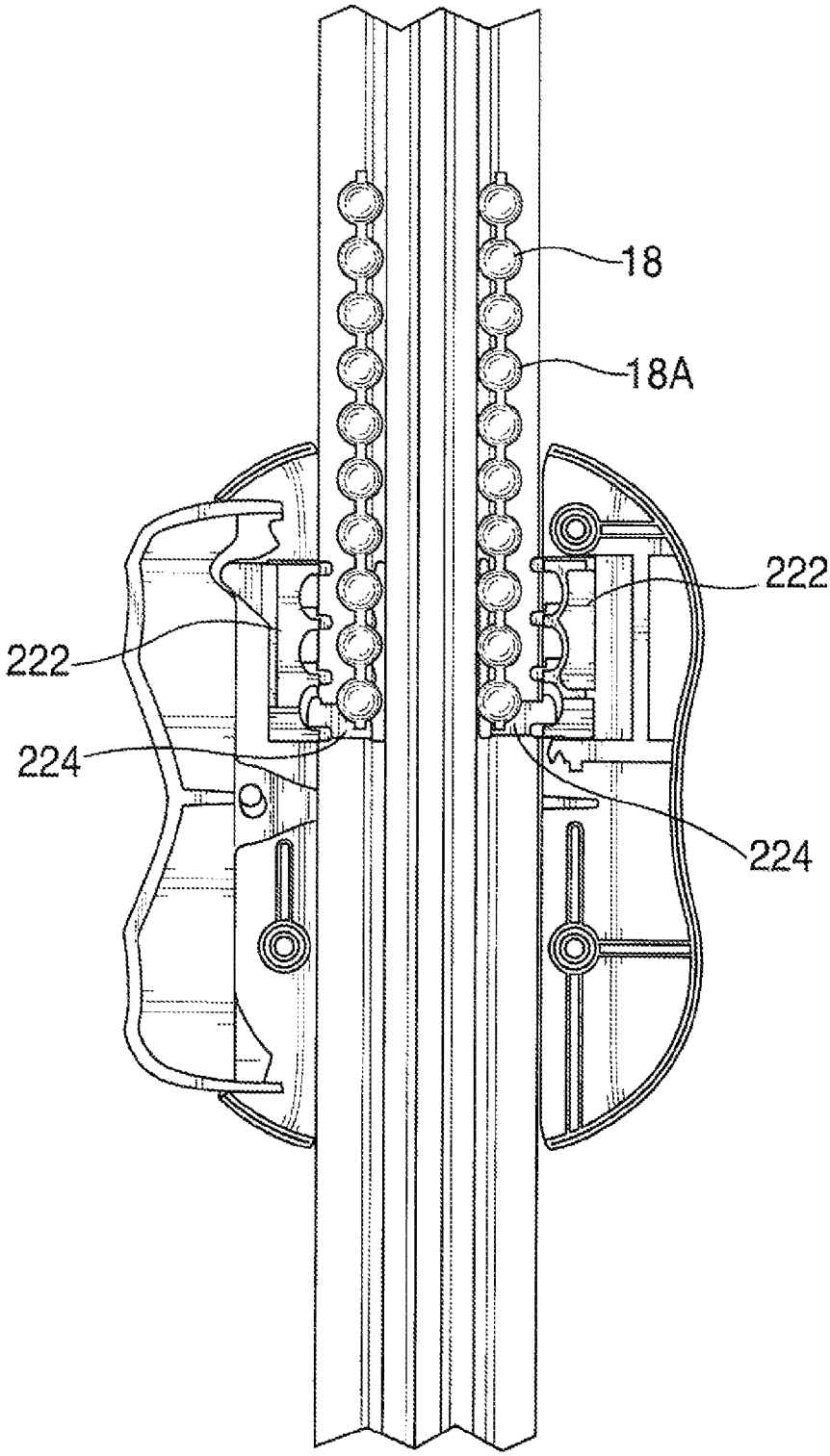
FIG. 9A shows a cross-sectional view of an alternate embodiment for the slide switch.
Figure 10:
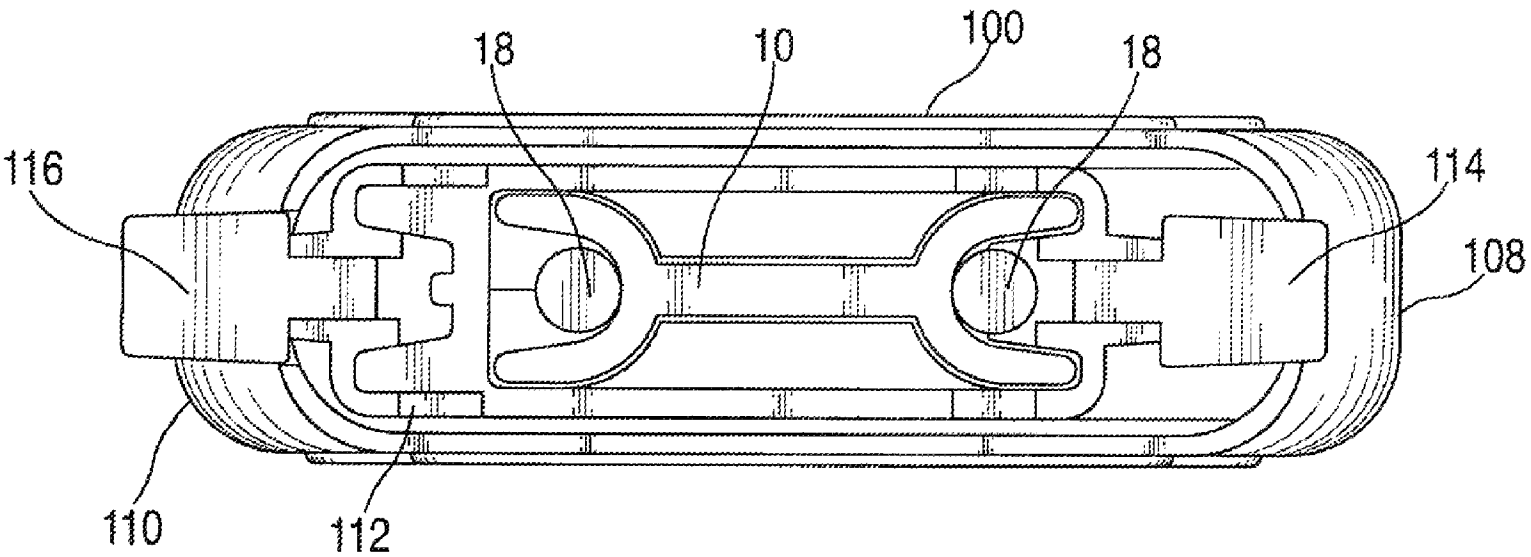
FIG. 10 shows a top view of the slide switch of FIGS. 8 and 9.

FIG. 9A shows another embodiment of the invention in which shoes 222 having a different shape than the ones in FIG. 9 is used. The shoes 222 are moved toward or away from the beads of the cord 18 by respective arms 224. These arms are offset from the plane of the shoes 222 to provide enough clearance for the shoes to move toward and away from the beads 18A as described above.

Figure 9B:
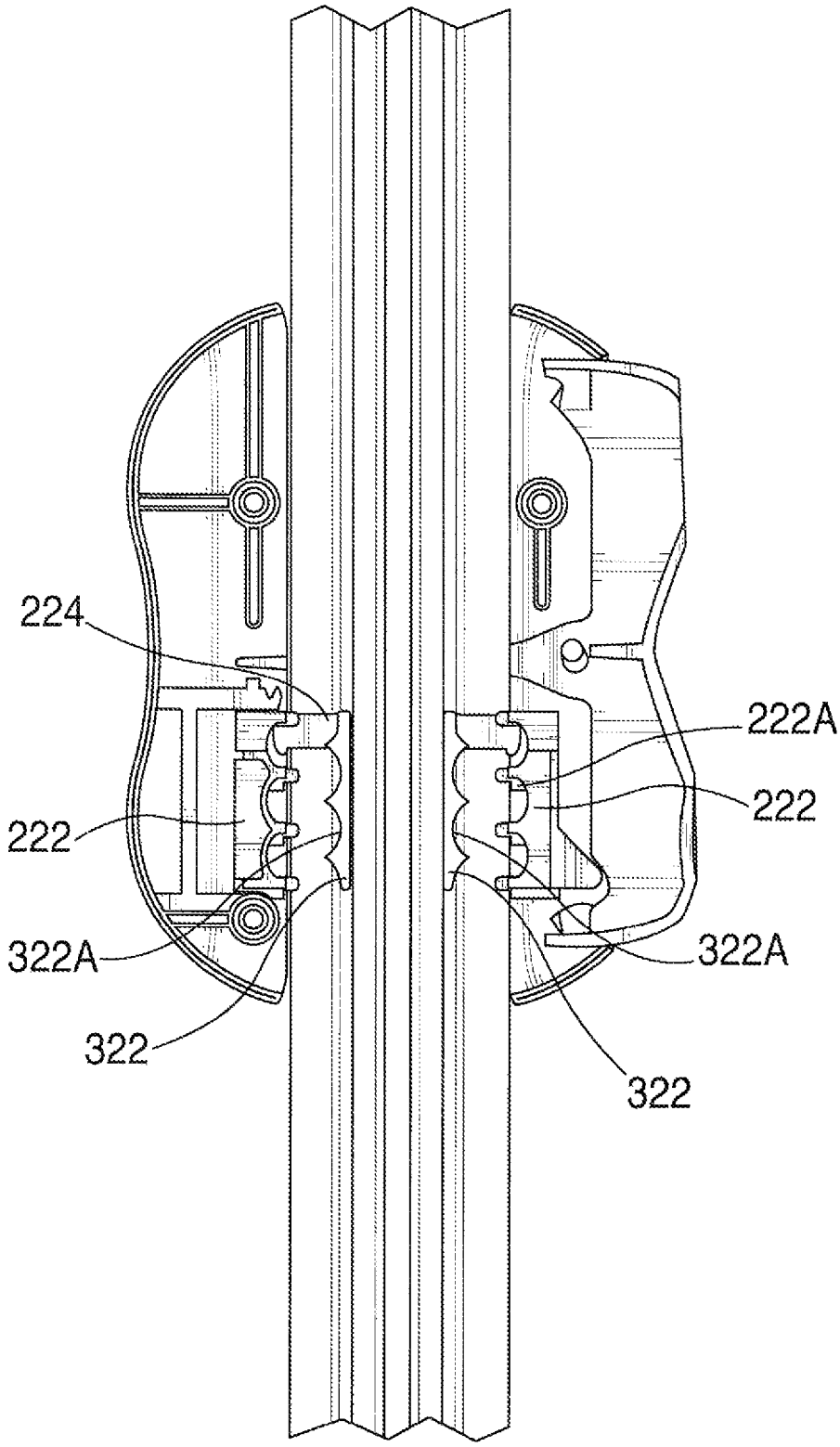
FIG. 9B shows a cross-sectional view of the slide switch of FIG. 9A with an insert for beadless cord.

As previously mentioned, the slide switch shown so far in the figures is well suited to engage a beaded cord 18 however, it may not operate so well with beadless cords. FIG. 9B shows an alteration for the slide switch of FIG. 9A. The alteration consists of the addition of a pair of auxiliary shoes 322. These auxiliary shoes are inserted into the slide switch when it is known that the slide switch will be used with a cord without beads. The auxiliary shoes include several bays, such as 322A that are longitudinally offset from the bays 222A of shoes 222. Normally, both sets of shoes are recessed from the cord so that slide switch can ride freely on the cord. When one of the shoes is moved inward toward the cord, the bays from the shoes 222A, 322A are arrange to form a twisted path form the cord thereby increasing the friction with the cord and making it difficult to slide the cord through the slide switch. At the same time the teeth between the bays on the shoes are advanced toward each other, thereby locking unto the cord. Releasing the shoes causes the shoes the unlock from the cord.

Numerous modifications may be made to the invention without departing from its scope as defined in the appended claims.

I claim:

1. A window treatment system comprising:

a cover having an open and a closed position;

a mechanism for controlling an operation of the cover;

a cord system coupled to said mechanism for operating said cover, said cord system including a cord engaging said mechanism and including a first cord portion configured to move said cover toward said open position and a second cord portion configured to move said cover toward said closed position, and an elongated housing arranged for mounting under said mechanism, said housing having first and second peripheral channels accepting said first and said cord portions, respectively; and a slider slidably mounted on said housing and movable in on one of a first direction and a second direction longitudinally with respect to said housing;

wherein said slider includes a body disposed about said cord and having a first button mounted on said body near said first cord portion, a second button mounted on said body near said second portion, a bracket disposed within said body and having ends solidly connected to said first and second buttons, a first shoe directly attached to said first button and a second shoe directly attached to said second button with said buttons and said shoes being aligned with respect to each other along an axis perpendicular to said cord portions;

said buttons, bracket and shoes cooperating when said first button is pushed inward to advance said first shoe to engage said first cord portion to cause said first portion to move in said first direction when said slider is moved in said first direction;

said buttons, bracket and shoes cooperating when said second button is pushed inward to cause said second shoe to engage said second cord portion to cause said second cord portion to move in said first direction when said slider is moved in said first direction.

2. The system of claim 1 wherein said cord is selected from one of a bead, a strap, a chain, a string, and a rope.

3. The system of claim 1 further comprising a header holding said mechanism, wherein said housing includes a connecting member for connecting said housing to said header.

4. The system of claim 1 further comprising a tensioning member for tensioning said cord.

5. A cord system for a window treatment for covering an architectural opening with a cover, said cover being selectively operated by a mechanism controlled by a cord, a cord system comprising:

an elongated housing constructed for mounting adjacent to said cover, said housing including a body with first and second channels extending longitudinally along said body and accepting first and second cord portions of said cord, respectively and a cord activating element sized and shaped for manual grasping and movement of said cord portions with respect to said housing along said channel;

said cord activating element including a body formed with a vertical opening, first and second lateral openings and a cord engaging member extending transverally to said elongate housing, said vertical opening being sized and shaped to slidably receive said elongated housing, said cord engaging member including a first button extending through said first lateral opening and terminating with a first shoe arranged and constructed to engage said first cord portion when said first button is pushed inward through said opening, a bracket having a first end attached to said first button and a second end, a second button attached to said second end and terminating in a second shoe when said second button is pushed inward to engage said second cord portion, said first button, first shoe, bracket, second shoe and second button being aligned between said first and second lateral openings.

6. The system of claim 5 further comprising a cord tensioning member for tensioning said cord.

7. The system of claim 1 wherein said cord is formed of a plurality of interconnected spherical beads and said shoes are formed with a contacting surface shaped and sized to engage said beads when said respective shoes are advanced toward said beads.

8. The system of claim 1 wherein said cord is made a beadless cord further comprising first and second auxiliary shoes arranged and configured to with said first and second shoes to define a twisted path for said beadless cord.

9. The system of claim 1 wherein said bracket and buttons are interlocked and have a first position in which said first button is advanced inwardly with said first shoe engaging said first cord portion, and a second position in which said second button is advanced into said body to engage said second cord portion.

10. The system of claim 9 wherein said bracket and buttons have a third position in which said first and second shoes engage said first and second portions simultaneously.

11. The system of claim 5 wherein said cord is formed of a plurality of interconnected spherical beads and said shoes are formed with a contacting surface shaped and sized to engage said beads when said respective shoes are advanced toward said beads.

12. The system of claim 5 wherein said cord is made a beadless cord further comprising first and second auxiliary shoes arranged and configured to with said first and second shoes to define a twisted path for said beadless cord.

13. The system of claim 5 wherein said bracket and buttons are interlocked and have a first position in which said first button is advanced inwardly with said first shoe engaging said first cord portion, and a second position in which said second button is advanced into said body to engage said second cord portion.

14. The system of claim 9 wherein said bracket and buttons have a third position in which said first and second shoes engage said first and second portions simultaneously.

15. The system of claim 9 wherein said bracket includes a first flat bracket portion disposed on one side of said elongated housing and a second flat bracket portion disposed on the other side of said elongated housing.

* * * * *